US005996162A

United States Patent [19]

Hsu

[11] Patent Number: 5,996,162

[45] Date of Patent: Dec. 7, 1999

[54] STRUCTURE OF AN EXTENDABLE AND MULTI-DIRECTIONAL CONNECTING ROD FOR DUSTERS

[76] Inventor: Hsing-Yuan Hsu, No. 274, Lane 125 Sec.3. Yuan Jyi Road, Chang Hua Hsien, Taiwan

[21] Appl. No.: 09/074,392

[22] Filed: May 18, 1998

[30] Foreign Application Priority Data

Oct. 9, 1997 [TW] Taiwan ..... 86217300

[51] Int. Cl.[6] ..... B25C 3/38

[52] U.S. Cl. ..... 15/144.1; 15/234; 15/176.2; 403/97

[58] Field of Search ..... 15/144.1, 172, 15/176.2, 176.3, 144.2, 145, 234; 403/97, 96; 248/288.11

[56] References Cited

U.S. PATENT DOCUMENTS

| | | | |
|---|---|---|---|
| 195,086 | 9/1877 | Brintzinghoffer | 156/144.1 |
| 452,375 | 5/1891 | Helmand | 403/96 |
| 764,124 | 7/1904 | Hayden | 15/145 |
| 959,211 | 5/1910 | Flach | 15/144.1 |
| 1,256,565 | 2/1918 | Inghram | 15/144.1 |
| 2,022,561 | 11/1935 | Gray | 30/318 |
| 2,469,050 | 5/1949 | Mygas | 15/144.1 |
| 2,750,616 | 6/1956 | Klugmann | 15/144.1 |
| 2,993,222 | 7/1961 | Laymon | 15/144.1 |
| 3,773,375 | 11/1973 | Nehls | 15/144.1 |

FOREIGN PATENT DOCUMENTS

| | | | |
|---|---|---|---|
| 243821 | 1/1947 | Switzerland | 15/144.1 |
| 24696 | 8/1906 | United Kingdom | 15/144.1 |

*Primary Examiner*—Gary K. Graham
*Attorney, Agent, or Firm*—Bacon & Thomas

[57] ABSTRACT

An improved structure of an extendable multi-directional connecting rod for dusters, in particular a duster having a bending structure and a retractable connecting rod structure connected to a rear end thereof, including a duster handle portion, a retaining connector, a locking connector, and a retractable connecting rod. The handle portion is hollow and internally threaded for receiving outer threads of the retaining connector. The retaining connector further has a curved plate portion behind the outer threads. The curved plate portion has a central round hole and radial grooves extending from the round holes at both sides of the curved plate portion. The locking connector includes a forked portion for receiving the curved plate portion and an internally threaded rear end portion for screwably engaging the retractable connecting rod. The forked portion is provided with a locking hole and opposed faces of the forked portion are each provided with a detent point, whereby the detent points will engage the corresponding radial grooves of the retaining connector to achieve angular positioning when the locking connector is turned with respect to the retaining connector. Hence, the direction and angle of a duster body with respect to the locking connector and the retractable connecting rod are adjustable to facilitate cleaning of higher spots.

1 Claim, 3 Drawing Sheets

STRUCTURE OF AN EXTENDABLE AND MULTI-DIRECTIONAL CONNECTING ROD FOR DUSTERS

BACKGROUND OF THE INVENTION (a) Field of the Invention

The present invention relates generally to an improved structure of an extendable multi-directional connecting rod for dusters, and more particularly to a structure comprising a retaining connector and a locking connector pivotally connected thereto, in which the locking connector is turnable with respect to the retaining connector which is connected to a handle portion of a duster body, so that a user may use the duster to reach the top of cabinets or dead corners without needing a stool or a ladder.

(b) Description of the Prior Art

Feather dusters are common devices used in cleaning. However, due to their fixed length they cannot be used to clean higher spots. The user will need to use a stool or ladder when cleaning higher spots, which may be dangerous. Recently, there is available on the market a kind of mop or wiper used in conjunction with different kinds of cleaning layers. It basically comprises a body the bottom portion of which is a planar foamed pad. The top side of the body is provided with a soft grip jacket which is formed with teeth or Y-shaped grooves. After a cleaning cloth is placed below the foamed pad, the surplus cloth material is folded upwardly and squeezed into the teeth or grooves, which will hold the cloth in position. However, such mops or wipers can be used to clean the floor or ceiling only. They cannot reach the top of cabinets or dead corners.

SUMMARY OF THE INVENTION

A primary object of the present invention is to provide an improved structure of an extendable multi-directional connecting rod for dusters, which comprises a duster handle portion, a retaining connector, a locking connector, and a retractable connecting rod. The handle portion is hollow and internally threaded for receiving outer threads of the retaining connector. The retaining connector further has a curved plate portion behind the outer threads. The curved plate portion has a central round hole and radial grooves extending from the round holes at both sides of the curved plate portion. The locking connector includes a forked portion for receiving the curved plate portion and an internally threaded rear end portion for screwably engaging the retractable connecting rod. The forked portion is provided with a locking hole and opposed faces of the forked portion are each provided with a detent point, whereby the detent points will engage the corresponding racial grooves of the retaining connector to achieve angular positioning when the locking connector is turned with respect to the retaining connector. Hence, the direction and angle of a duster body with respect to the locking connector and the retractable connecting rod are adjustable to facilitate cleaning of higher spots.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
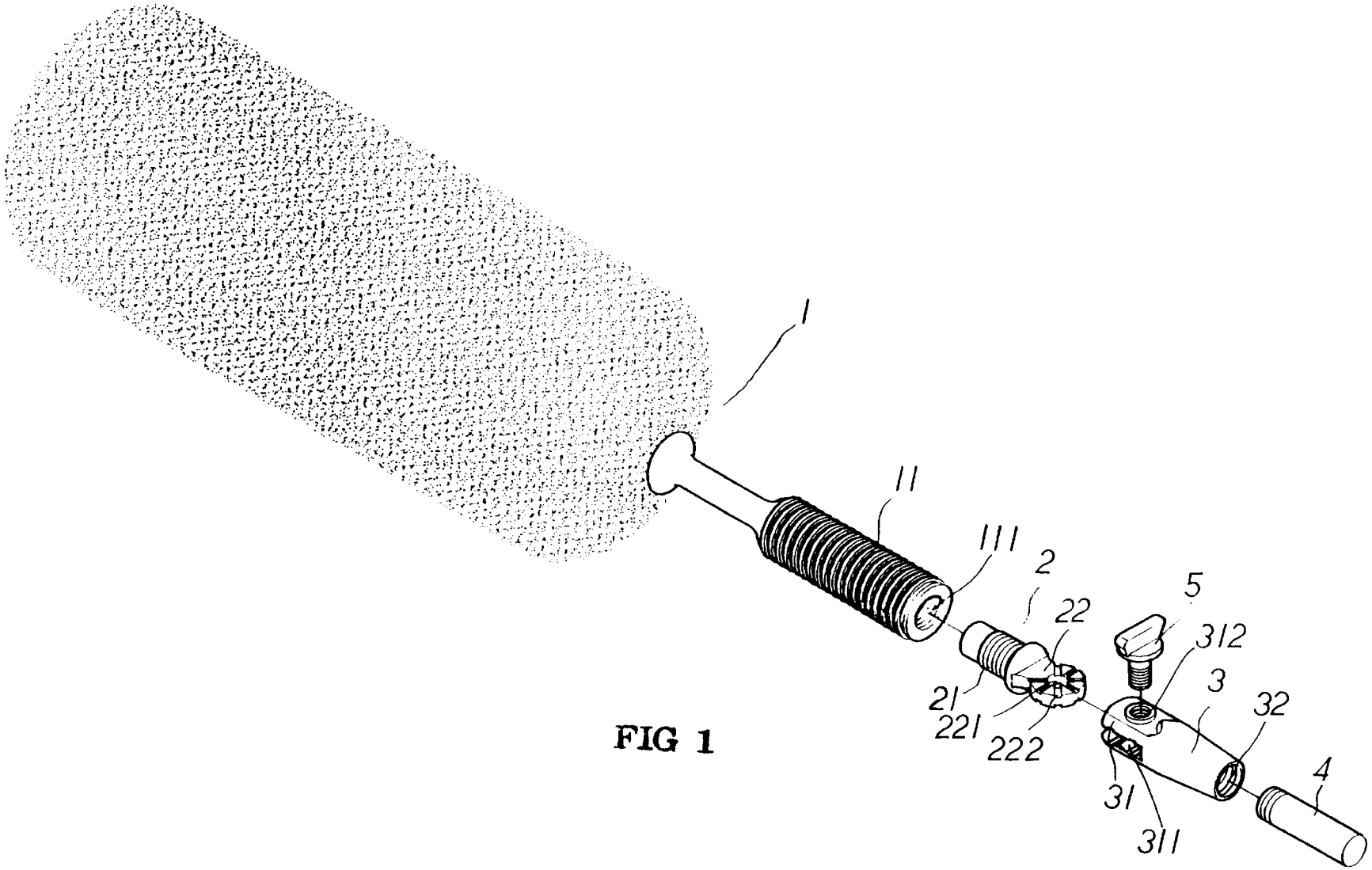
FIG. 1 is an exploded view of the present invention.
Figure 2:
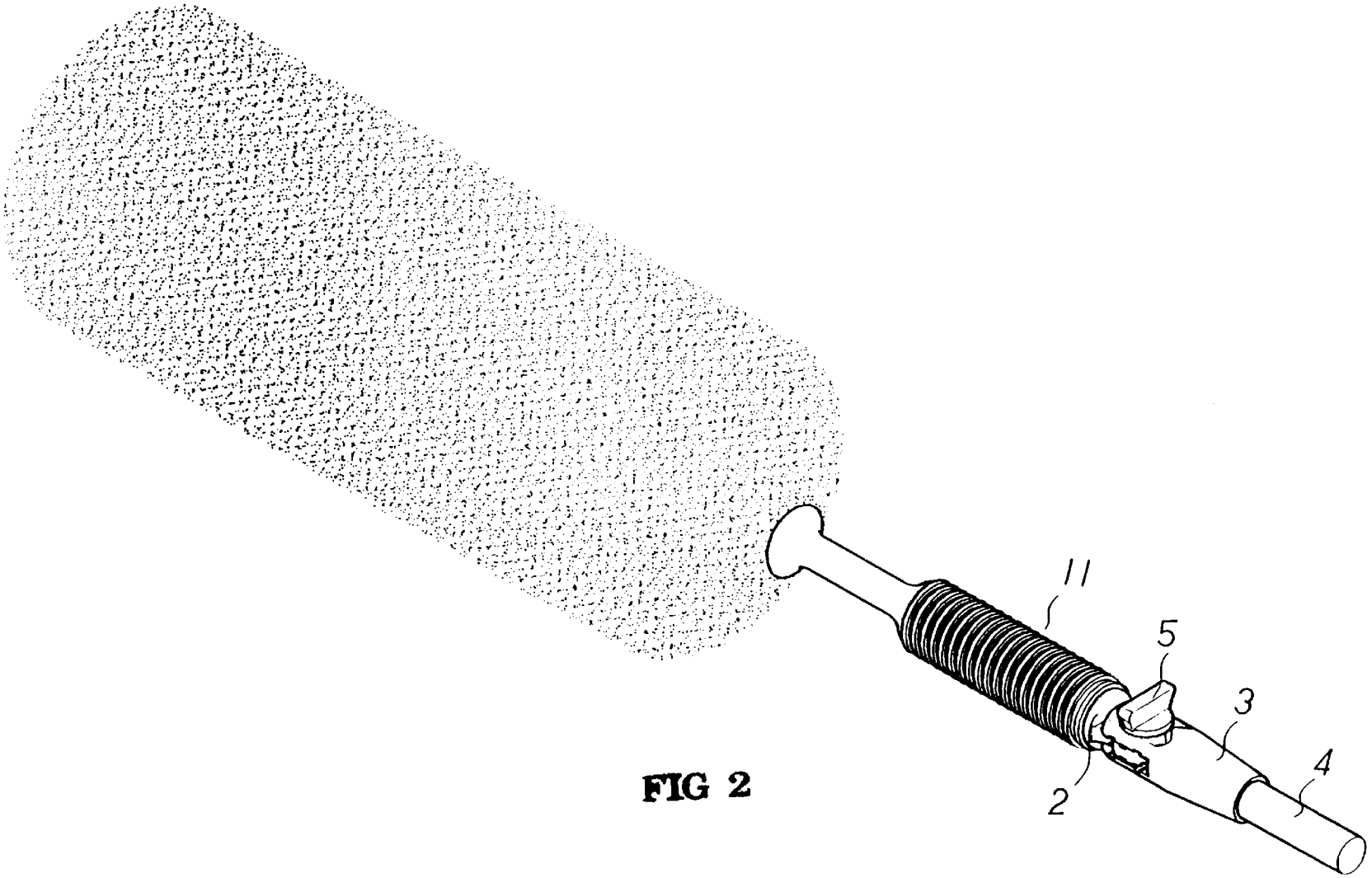
FIG. 2 is a perspective view of the present invention.
Figure 3:
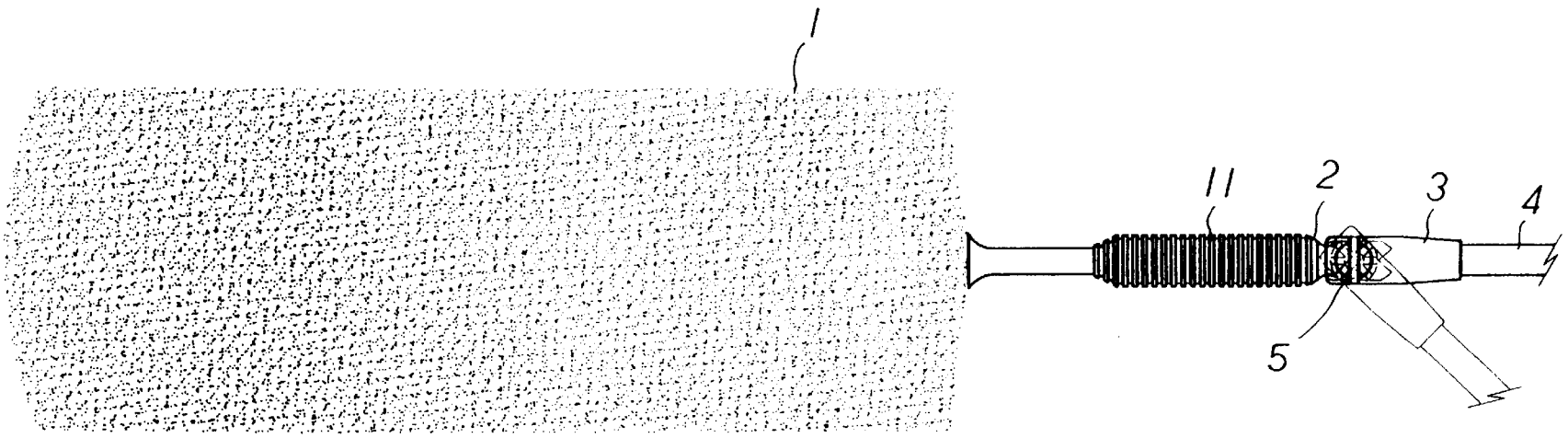
FIG. 3 is a schematic view of an embodiment of the present invention illustrating its operation.

With reference to FIGS. 1, 2, and 3, the improved structure of an extendable multi-directional connecting rod for dusters according to the present invention comprises a duster body 1, a retaining connector 2, a locking connector 3, and a retractable connecting rod 4.

The duster body 1 includes a tubular hollow handle portion 11 at a rear end thereof, the handle portion 11 being provided with internal threads 111 for engaging the retaining connector 2.

The retaining connector 2 includes external threads 21 near an upper end thereof, and a curved plate portion 22 at a rear end thereof. The curved plate portion 22 is centrally provided with a round hole 221, and radial grooves 222 extend outwardly from the round hole 221 on both sides of the curved plate portion 22 to form retaining portions.

The locking connector 3 includes a forked portion 31 at a front end thereof, and a rear end portion forming a hollow internally threaded portion 32. The forked portion 31 includes opposed inner faces each of which is provided with a detent portion 311. The forked portion 31 is further provided with a locking hole 312.

The retractable connecting rod 4 includes a threaded portion at a front end thereof for engaging the threaded portion 32 at the rear end of the locking connector 3.

In assembly the curved plate portion 22 of the retaining connector 2 is inserted into the forked portion 31 of the locking connector 3, and a winged bolt 5 is inserted into the locking hole 312 and the round hole 221 of the curved plate portion 22 to pivotally lock the retaining connector 2 and the locking connector 3 together.

In use, the locking connector 3 may be turned with respect to the retaining connector 2 by means of the dent points 311 which engage corresponding radial grooves 222 of the retaining connector 2. By means of this arrangement, the locking connector 3 is positioned at each turning thereof about a desired angle. The locking connector 3 may be turned about 90 degrees with respect to the duster body 1. In view of the aforesaid, it can be appreciated that the duster according to the present invention is orientation- and angle-adjustable to allow easy cleaning of the top of cabinets or wardrobes or dead corners without needing stools or ladders.

Although the present invention has been illustrated and described with reference to the preferred embodiment thereof it should be understood that it is in no way limited to the details of such embodiment but is capable of numerous modifications within the scope of the appended claims.

What is claimed is:

1. An improved structure of an extendable multi-directional connecting rod for dusters, comprising a retaining connector and a locking connector, which are respectively connected to a handle portion of a duster body and a retractable connecting rod, wherein said retaining connector includes external threads near an upper end thereof, and a curved plate portion at a rear end thereof, said curved plate portion being centrally provided with a round hole, and radial grooves extending outwardly from said round hole on both sides of said curved plate portion to form retaining portions for connection with said locking connector; and said locking connector includes a forked portion at a front end thereof, and a rear end portion forming a hollow internally threaded portion, said forked portion including opposed inner faces each of which is provided with a detent portion said forked portion being further provided with a locking hole; and said curved plate portion of said retaining connector is inserted into said forked portion of said locking connector, and a winged bolt is inserted into said locking hole and said round hole of said curved plate portion to pivotally lock said retaining connector and said locking connector together, whereby said locking connector may be turned with respect to said retaining connector by means of said dent points which engage corresponding radial grooves of said retaining connector, so that said locking connector is positioned at each turning thereof about a desired angle.

* * * * *